US009511987B2

(12) United States Patent
Hayakawa et al.

(10) Patent No.: US 9,511,987 B2
(45) Date of Patent: Dec. 6, 2016

(54) APPARATUS FOR AND METHOD OF ADJUSTING DILUTION RATIO IN BEVERAGE DISPENSER

(71) Applicant: Hayakawa Sanki, Inc., Tokyo (JP)

(72) Inventors: Yohei Hayakawa, Tokyo (JP); Satoshi Wakui, Tokyo (JP); Yasushi Takayanagi, Tokyo (JP)

(73) Assignee: Hayakawa Sanki, Inc., Tokyo (JP)

( * ) Notice: Subject to any disclaimer, the term of this patent is extended or adjusted under 35 U.S.C. 154(b) by 40 days.

(21) Appl. No.: 13/971,462

(22) Filed: Aug. 20, 2013

(65) Prior Publication Data

US 2014/0061237 A1 Mar. 6, 2014

(30) Foreign Application Priority Data

Sep. 5, 2012 (JP) ..... 2012-194705

(51) Int. Cl.
*B67D 7/74* (2010.01)
*B67D 1/00* (2006.01)
*B67D 1/10* (2006.01)

(52) U.S. Cl.
CPC ..... *B67D 1/0028* (2013.01); *B67D 1/0037* (2013.01); *B67D 1/108* (2013.01)

(58) Field of Classification Search
CPC .. B67D 1/108; B67D 1/0037; B67D 1/0027; B67D 1/1204; B67D 1/1293
USPC ..... 222/63, 129.3, 145.5, 145.6; 417/45, 53
See application file for complete search history.

(56) References Cited

U.S. PATENT DOCUMENTS

| | | | | |
|---|---|---|---|---|
| 4,886,190 | A * | 12/1989 | Kirschner | B67D 1/0037 222/129.1 |
| 4,955,507 | A * | 9/1990 | Kirschner et al. | 222/63 |
| 5,797,519 | A * | 8/1998 | Schroeder et al. | 222/129.1 |
| 5,875,930 | A * | 3/1999 | Nakajima et al. | 222/129.1 |
| 6,394,312 | B1 * | 5/2002 | Endou | 222/129.1 |
| 7,036,687 | B1 * | 5/2006 | Lowe | 222/145.5 |
| 7,077,290 | B2 * | 7/2006 | Bethuy et al. | 222/23 |
| 2002/0060226 | A1 * | 5/2002 | Kameyama | 222/1 |
| 2007/0145074 | A1 * | 6/2007 | Sevcik | B67D 1/06 222/129.1 |
| 2008/0047973 | A1 * | 2/2008 | Elsom et al. | 222/57 |
| 2009/0020553 | A1 * | 1/2009 | Litterst et al. | 222/1 |
| 2010/0036528 | A1 * | 2/2010 | Minard et al. | 700/265 |

FOREIGN PATENT DOCUMENTS

JP 2002-285977 10/2002

* cited by examiner

*Primary Examiner* — Kevin P Shaver
*Assistant Examiner* — Robert Nichols, II
(74) *Attorney, Agent, or Firm* — Leighton K. Chong

(57) ABSTRACT

A dilution ratio adjusting apparatus in a beverage dispenser and a method of dilution adjustment calculates driving pulse numbers and pulse frequencies necessary for operating tube pumps discharging concentrated syrup based on dilution ratio information and basic flow rate information for discharging the concentrated syrup to thereby control the operation of the tube pumps, whereby easy and quick change in setting of the beverage dispenser is achieved even when changing of a concentrated syrup to another concentrated syrup with a different dilution ratio.

4 Claims, 8 Drawing Sheets

Fig. 2a
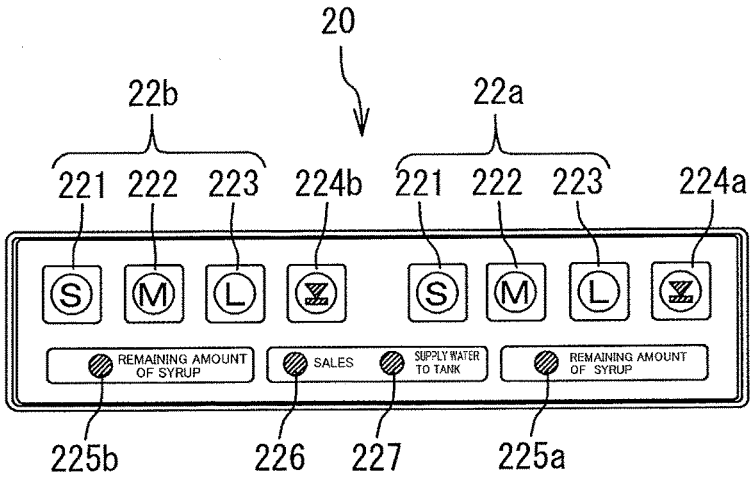
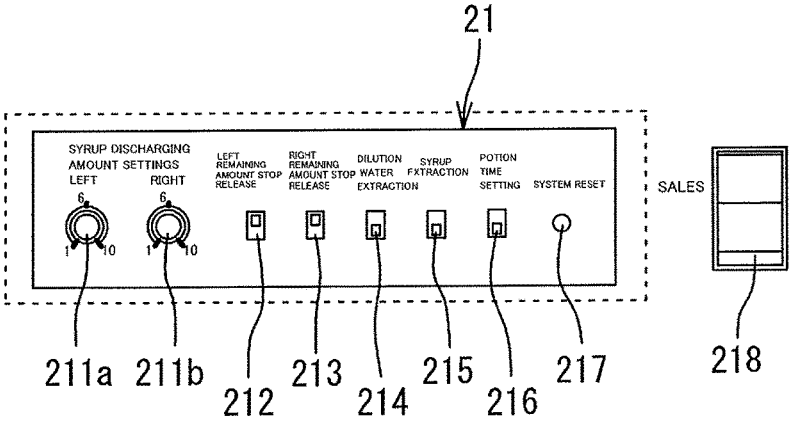
Fig. 2b

APPARATUS FOR AND METHOD OF ADJUSTING DILUTION RATIO IN BEVERAGE DISPENSER

BACKGROUND OF THE INVENTION

1. Field of the Invention

The present invention relates to an apparatus for and a method of adjusting a dilution ratio in a beverage dispenser. More specifically, it relates to a dilution ratio adjusting apparatus adapted for use in a beverage dispenser that fixes a beverage by supplying an appropriate amount of dilution water according to a dilution ratio that is specific to a concentrated syrup, and a method for carrying out the dilution ratio adjusting in a beverage dispenser.

2. Description of the Related Art

A beverage dispenser is configured as a machine which is provided with one or a plurality of dilution water tanks for storing dilution water, a syrup tank or a BIB (Bag-In-Box) for storing concentrated syrup, and a cooling mechanism or the like, and is employed for pouring a beverage into a container such as a paper cup after application thereto a constant and defined dilution, in response to pressing of a press button on the machine. An example thereof is disclosed in Japanese Unexamined Patent publication 2002-285977 (JP-A-2002-285977). A cup beverage dispenser of the JP-A-2002-285977 is configured to be provided with a syrup tank that is set in a cooling box to store concentrated syrup, a cooling section to generate dilution water by cooling tap water or the like, a tube pump for causing the syrup tank to discharge a given amount of concentrated syrup, a mixer for mixing the concentrated syrup supplied by the tube pump and the cooled dilution water supplied by the tube pump to thereby pouring the same into a container such as a paper cup or the like disposed on a tray.

In the described beverage dispenser, the beverage is fixed by making an amount of supply of the dilution water per unit time be constant, and adjusting an amount of supply of the concentrated syrup to be mixed in such a manner that a required amount of the syrup is supplied within substantially the same time duration as that of the time during which the dilution water is supplied. In this case, operation setting of the beverage dispenser can be left unchanged if dilution ratios of any type of concentrated syrup are constant, however, in a case where a replacement of the concentrated syrup with a separate concentrated one having a different dilution ratio is conducted, the supplying amount of the concentrated syrup per unit time or the supplying amount of the dilution water per unit time, or both amounts need to be adjusted each time.

Nevertheless, in a conventional beverage dispenser, a change of the setting of an amount of supply of the concentrated syrup relative to t the dilution water to be supplied per unit time is needed to be performed manually by a user or an administrator (hereinbelow referred to as "user or the like"), which has often been a troublesome work. Further, if the setting of the dilution ratio is incorrect, not only it will affect the taste of the beverage, but also, there has been a problem such that, if the amount of the concentrated syrup is set in a larger quantity than its defined amount, the concentrated syrup will run out before a preliminarily expected number of beverage sales is achieved, which would result in an adverse affect on the profit.

SUMMARY OF THE INVENTION

Thus, the present invention was made in view of the above-described problem, and an object thereof is to provide an apparatus for and a method of adjusting a dilution ratio in a beverage dispenser that are able to automatically adjust a supplying amount of concentrated syrup when a user or the like designates a dilution ratio of the concentrated syrup.

More specifically, the present invention has its object to provide an apparatus for and a method of adjusting a dilution ratio in a beverage dispenser that calculate a necessary amount of the concentrated syrup on the basis of a supplying amount of the concentrated syrup against each operation pulse of a concentrated syrup supplying motor, and adjusts the supplying amount of the concentrated syrup depending on a difference of the container size, such as S, M, L and so on.

In accordance with one aspect of the present invention for solving the described problem, there is provided an apparatus for adjusting a dilution ratio in a beverage dispenser that fixes a beverage by diluting concentrated syrup with dilution water according to a predetermined dilution ratio, the dilution ratio adjusting apparatus including a controller that calculates a driving pulse number and a pulse frequency that are necessary for operating a stepping motor which constitutes a drive source of a tube pump on the basis of dilution ratio information being a dilution ratio specific to the concentrated syrup and a basic flow rate information regarding a basic flow rate that is a discharging amount per one pulse of the tube pump that conveys the concentrated syrup, to thereby control the operation of the tube pump.

In accordance with the present invention for solving the described problem, there is provided a dilution ratio adjusting apparatus in the beverage dispenser, as described above, in which the controller controls the tube pump and a dilution water supplying unit in a manner such that starting and completing of supply of a necessary amount of the dilution water and a necessary amount of the concentrated syrup occur at substantially the same timings.

In accordance with the present invention, there is provided a dilution ratio adjusting apparatus in a beverage dispenser, as described above, wherein the controller includes a fine adjustment unit that performs so as to increase or decrease either the calculated driving pulse number or the calculated pulse frequency to thereby perform a fine adjustment of the dilution ratio.

In accordance with another aspect of the present invention, there is provided a method of adjusting a dilution ratio in a beverage dispenser that fixes a beverage by diluting a concentrated syrup with dilution water according to a predetermined dilution ratio, the dilution ratio adjusting method including: calculating a driving pulse number and a pulse frequency that are necessary for operating a stepping motor constituting a drive source of the tube pump on the basis of dilution ratio information being the dilution ratio specific to the concentrated syrup and basic flow rate information regarding a basic flow rate being a discharging amount per one pulse of the tube pump that conveys the concentrated syrup, to thereby control the operation of the tube pump.

In accordance with the present invention, there is provided a dilution ratio adjusting method in a beverage dispenser, as described above, further including: a step of storing in a memory means, the dilution ratio information being the dilution ratio specific to the concentrated syrup and the basic flow rate information regarding the basic flow rate being the discharging amount per one pulse of the tube pump that conveys the concentrated syrup; a step of calculating a necessary amount of the dilution water and time necessary for supplying the calculated amount of the dilution water depending on difference of a size of the beverage to be served; a step of calculating a necessary driving pulse number and a pulse frequency that are fed to the tube pump for supplying the concentrated syrup by substantially the same time period as the supplying time of the dilution water; and a step of operating the tube pump according to the calculated driving pulse number and the calculated pulse frequency.

In accordance with the present invention, a dilution ratio adjusting method in a beverage dispenser, as described above, further includes a feature wherein a size of the beverage to be served is classified by a plurality of sizes with different capacities, and a necessary amount of the dilution water and time necessary for supplying the calculated amount of the dilution water are calculated depending on a designated size of the beverage.

In accordance with the present invention, a dilution ratio adjusting method in a beverage dispenser, as described above, further includes a step of increasing or decreasing the calculated driving pulse number or the calculated pulse frequency to thereby perform a fine adjustment of the dilution ratio.

According to the present invention, the beverage dispenser is permitted to preliminarily input the dilution ratio data of the concentrated syrup, so that shifting of the concentrated syrup having one dilution ratio to a new concentrated syrup having a different dilution ratio can be advantageously achieved without performing any troublesome setting such as a changing operation setting of the tube pump even in a case of replacement of the concentrated syrup with a new one having a different dilution ratio. Accordingly, even during extremely busy operation hours of the beverage dispenser, the time necessary for the replacement of the concentrated syrup or syrups can be appreciably reduced compared with the conventional techniques, and as a result, the replacement of the concentrated syrup or syrups can be quickly achieved without leaving a customer or customers waiting for a long time.

BRIEF DESCRIPTION OF THE DRAWINGS

FIG. 2A is a front view illustrating an operation panel at a door front portion of the beverage dispenser shown in FIG. 1;

FIG. 2B is a front view illustrating an adjusting switch panel at a door back portion;

DESCRIPTION OF THE PREFERRED EMBODIMENT

Figure 1:
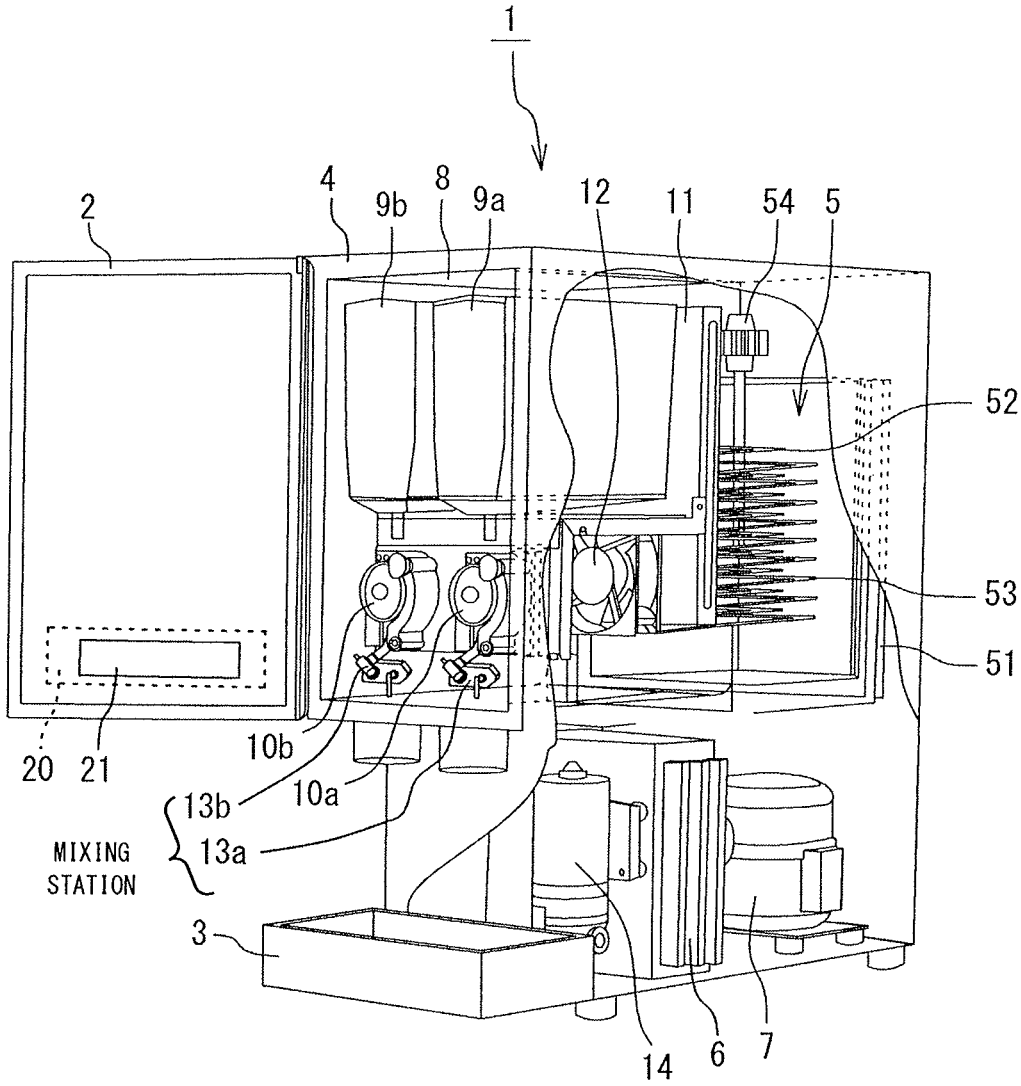
FIG. 1 is a perspective view illustrating an internal configuration of a beverage dispenser according to the present invention.

There is provided, hereinbelow, a detailed description of an apparatus for adjusting a dilution ratio of a beverage dispenser and a method of adjusting of dilution ratio, according to the present invention, based on a preferred embodiment thereof. FIG. 1 is a perspective view illustrating an internal configuration of the beverage dispenser according to the present invention.

[Configuration of the Beverage Dispenser J

Referring to FIG. 1, a beverage dispenser 1 is generally configured by having a door 2, a box-shaped housing 4 provided with a tray 3 onto which a container such as a paper cup is placed, a cooling unit 5 disposed at a rear portion of the housing 4 to generate cold water, a condenser 6 disposed at a lower portion of the housing 4 to make diffusion of heat, a compressor 7 that compresses refrigerant supplied through the condenser 6, a cooling box 8 arranged in the housing so as to face the door 2, two syrup tanks 9*a* and 9*b* as container units for containing diverse concentrated syrups (orange, apple, grapefruit, cranberry, oolong tea, or the like) that are detachably mounted in the cooling box 8, two tube pumps 10*a* and 10*b* that are provided at a lower portion of the cooling box 8 to discharge a given amount of the concentrated syrup, a heat exchanger 11 that performs cooling operation by means of a medium that is supplied from a later-described multi pump 54 of the cooling unit 5, a fan motor 12 for enhancing the heat exchange carried out by the heat exchanger 11, two mixers 13*a* and 13*b* (collectively referenced in FIG. 1 as a "mixing station") provided at lower portions of the tube pumps 10*a* and 10*b* for mixing the concentrated syrup and dilution water cooled by the cooling unit 5, and pours the same into the paper cup or the like, and a dilution water pump 14 that supplies the mixers 13*a* and 13*b* with the dilution water for diluting the concentrated syrup.

Further, the cooling unit 5 is provided so as to have therein a cold-water tank 51, a cold-water coil 52, an evaporator coil 53, and the multi pump 54 and so on.

The door 2 is mounted to be openable and closable on a front portion of the housing 4, and is opened upon replenishing the concentrated syrup and maintenance of the apparatus or the like, and is usually closed and locked. Further, an operation panel 20 shown in FIG. 2A having a plurality of key switches to be operated by a user or the like is provided at a front surface of the door 2, and an adjusting switch panel 21 shown in FIG. 2B operated by the user or the like when an operation setting of the beverage dispenser 1 are required, is provided at a rear surface of the door 2.

Since the beverage dispenser 1 is provided with two types of beverage fixing systems as described above, cup selection keys 22*a* and 22*b* are provided on the operation panel 20 at left and right sides with identical key arrangements as best shown in FIG. 2A. The cup selection key 22*a* includes a small cup key 221 (S=192 cc) for selecting sales of a small cup, a medium cup key 222 (M=265 cc) for selecting sales of a medium cup, and a large cup key 223 (L=334 cc) for selecting sales of a large cup, and this configuration applies similarly to the side of the cup selection key 22*b*. Further, a cancel/pour (C/P) key 224*a* for performing a cancellation/manual extraction is provided on the side of the cup selection key 22*a* and a C/P key 224*b* is provided on the side of the cup selection key 22*b*. Moreover, syrup remaining amount warning lamps 225*a* and 225*b* that are turned on when a remaining amounts of the concentrated syrup come to be at set values or less, a sales lamp 226 that is turned off upon when sales by the cup selection keys 22*a* and 22*b* become unavailable, and a tank water supply warning lamp 227 that is turned on when water kept in the cold water tank decreases to a defined amount are provided at a lower portion of the cup selection keys 22*a* and 22*b*.

Further, as shown in FIG. 2B, the adjusting switch panel 21 arranged on the rear surface of the door 2 is provided with a syrup extraction setting tab (left) 211*a* to adjust an extracting amount of the concentrated syrup, and a syrup extraction setting tab (right) 211*b*, a left side remaining amount stop release switch 212 for releasing the unavailability of sales of the beverage fixing system on the left side, a right side remaining amount stop release switch 213 for releasing the unavailability of sales of the beverage fixing system on the right side, a dilution water extracting switch 214 for permitting the dilution water to flow for a certain time period upon adjustment of the dilution ratio, a concentrated syrup extracting switch 215 for permitting the concentrated syrup to flow for a certain time period upon the adjustment of the dilution ratio, a portion time setting switch 216 that sets a time period for extracting a desired beverage, and a system reset button 217 for performing resetting of respective settings. Further, a transparent plastic covering that is not shown in the drawing is placed on the adjusting switch panel 21, so that a human hand will not make erroneous contact with the panel upon performing work by opening the door 2. Moreover, a sales switch 218 is provided so as to be positioned adjacent to the adjusting switch panel 21 on the upper right side of the drawing. In a case where this sales switch 218 is not ON, a sales operation of beverages is not performed even if the cup selection keys 22*a* and 22*b* are pressed.

Figure 3:
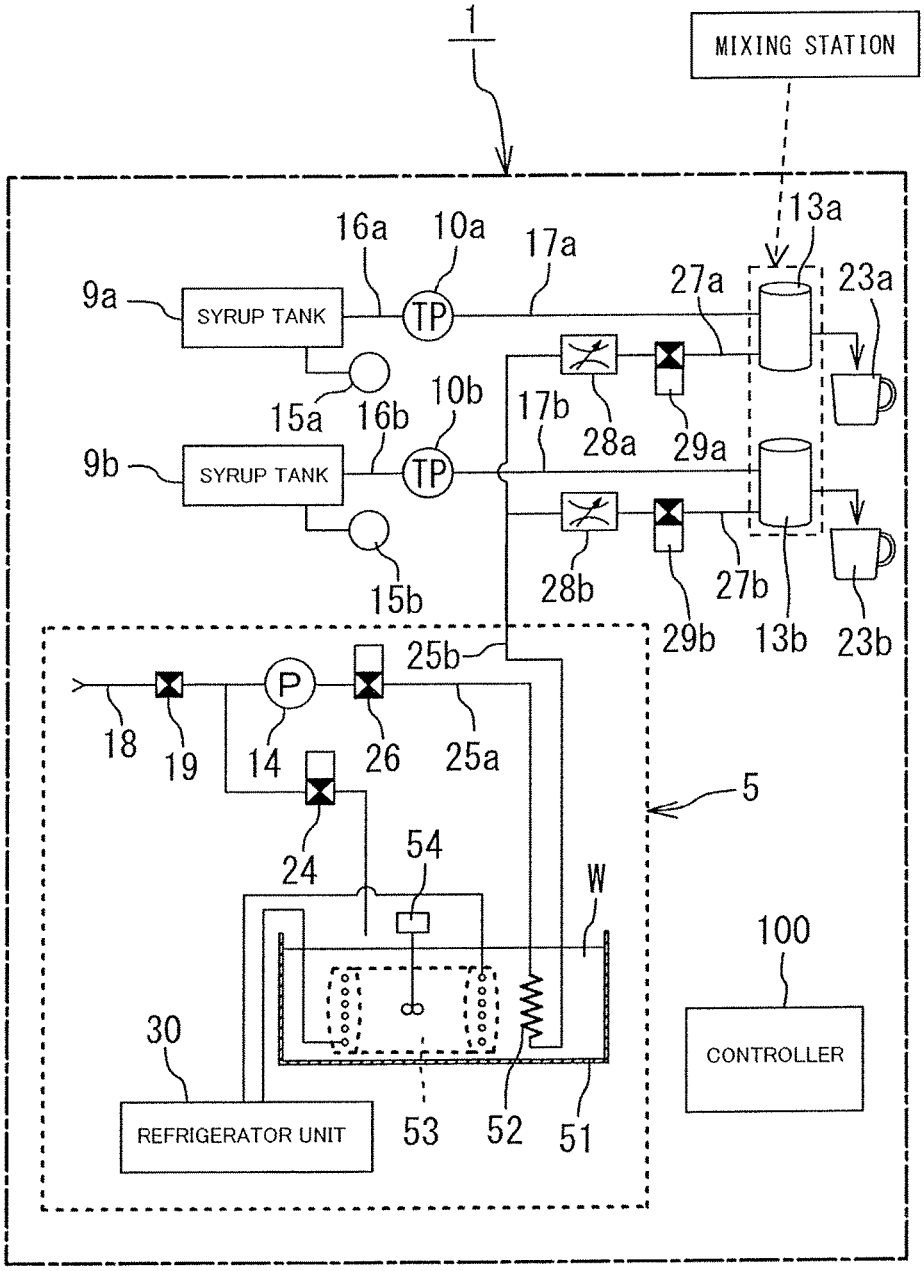
FIG. 3 is a systematic view illustrating a configuration of a beverage supplying system of the beverage dispenser according to the present invention.
Figure 5:
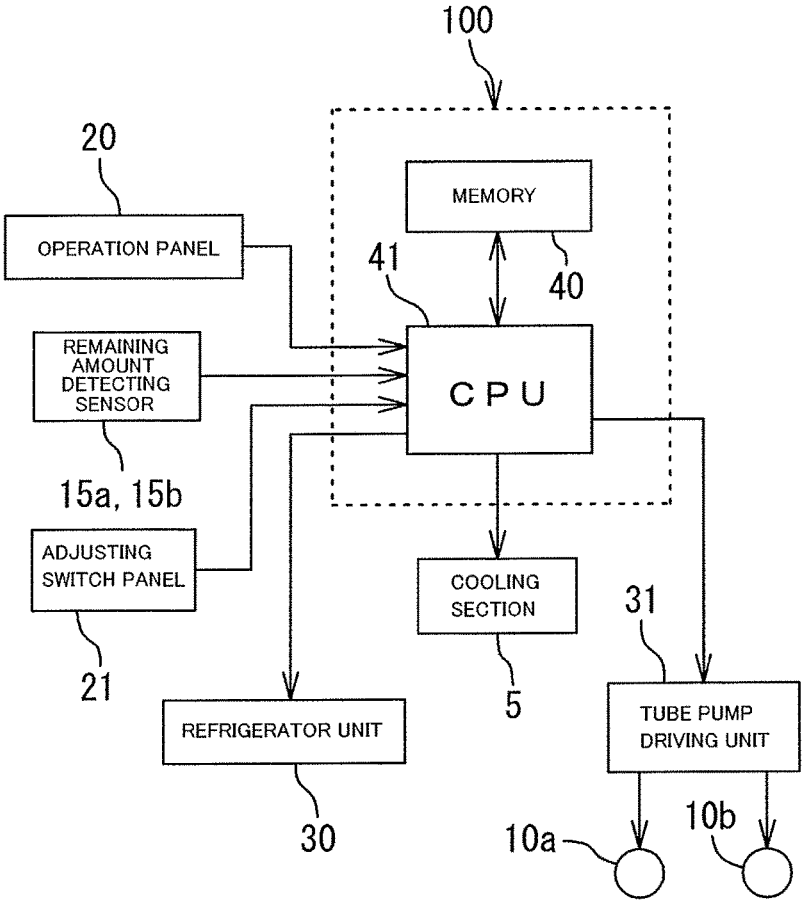
FIG. 5 is a block diagram showing a configuration of a controller of the beverage dispenser according to the present invention.

The syrup tanks 9*a* and 9*b* are containers made of, for example, resin, and can be detached from the cooling box 8 upon the replenishment or replacement of the concentrated syrup, cleaning of the beverage dispenser 1 and so forth. Note that a bag in box (BIB) in which the concentrated syrup is filled may be used instead of the syrup tanks 9*a* and 9*b*. Further, as shown in FIG. 3, remaining amount detecting sensors 15*a* and 15*b* that detect remaining amount of the concentrated syrup are attached to respective ones of the syrup tanks 9*a* and 9*b*, and detection outputs thereof are inputted to a CPU 41 as shown in FIG. 5. Further, the tube pumps 10*a* and 10*b* (collectively referenced in FIG. 3 as the "mixing station") are connected to the syrup tanks 9*a* and 9*b* via tubes 16*a* and 16*b*, respectively.

Figure 4:
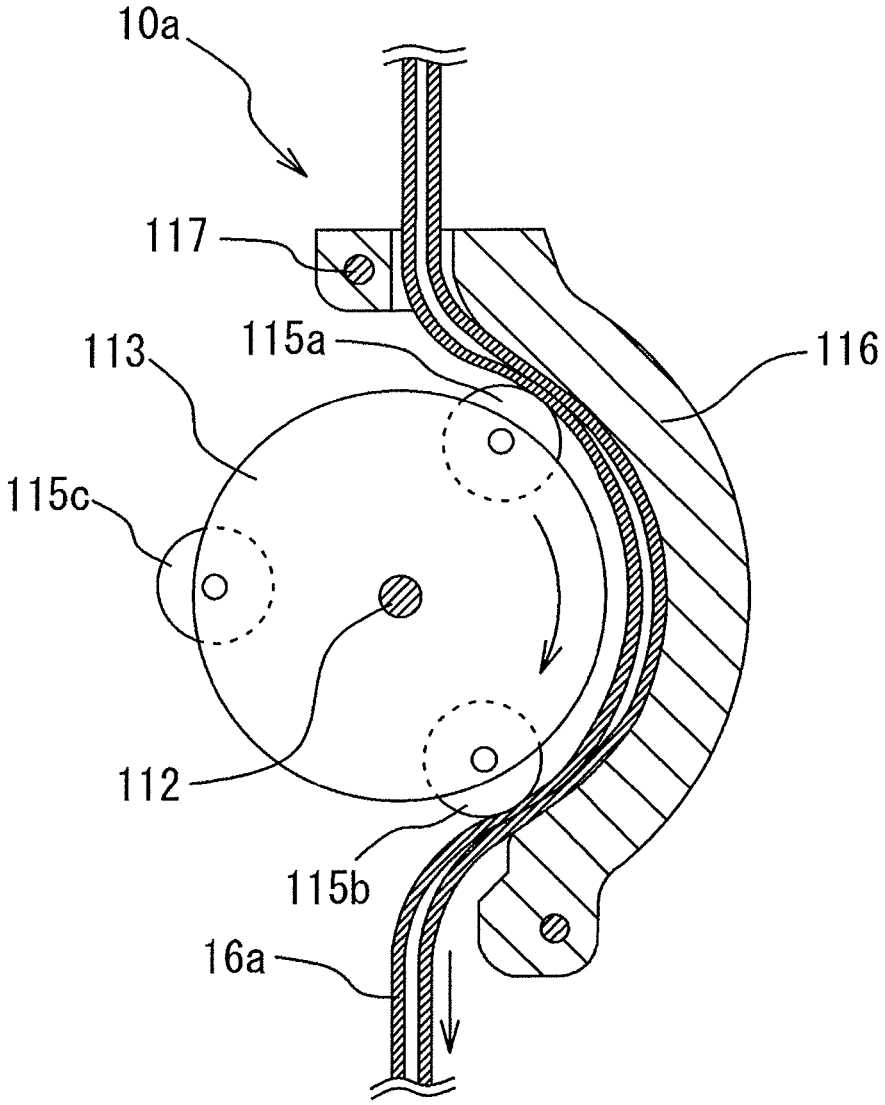
FIG. 4 is a schematic front view of a tube pump.

The tube pumps 10*a* and 10*b* are pumps that supply the concentrated syrup in pulsations, and a schematic configuration of the tube pump 10*a* is best shown in FIG. 4. Note that the tube pump 10*b* is configured similarly. The tube pump 10*a* is generally configured to have a circular-shaped rotor 113, and an arc-shaped fixed guide 116 arranged in proximity of a circumferential portion of the circular-shaped rotor 113. The rotor 113 is rotatably supported via a drive shaft 112 rotatably driven by a driving device such as a non-illustrated stepping motor, and three separate squeeze rollers 115*a*, 115*b* and 115*c* are freely rotatably attached in the vicinity of the circumferential portion of the rotor 113. Further, the tube 16*a* extending from the syrup tank 9*a* is disposed between the circumferential portion of the rotor 113 and the fixed guide 116. Note that the fixed guide 116 is formed to be swingable with respect to a fulcrum provided by a pin 117. In such a configuration, when the rotor 113 rotates in a direction of an arrow by rotating the drive shaft 112, the concentrated syrup flowing in the tube 16*a* is conveyed therefrom and fed out toward a downside. Thus, supply of the concentrated syrup existing in the tube 16*a* which is sandwiched by two squeeze rollers 115*a* and 115*b* is performed thereby.

The mixers 13*a* and 13*b* (collectively referenced as the "mixing station" in FIG. 1) are connected to the tube pumps 10*a* and 10*b* via tubes 17*a* and 17*b*, respectively and the beverage fixing is performed by mixing the concentrated syrup supplied from the tube pumps 10*a* and 10*b* and the dilution water supplied from the cooling unit 5. It should be noted that the cooling unit 5 is configured as shown in FIG. 3 by including the above-described cold-water tank 51, cold-water coil 52, evaporator coil 53, multi pump 54, and so forth, where tap water or the liker is supplied to the cold-water tank 51 via a tube 18 as cooling water, and a flow rate thereof is controlled by a pressure reducing valve 19 and a water supply solenoid valve 24. The pressure reducing valve 19 is provided for preventing an excessive water pressure from being applied to the dilution water pump 14, and the water supply solenoid valve 24 is provided for controlling an amount of water supply to the cold-water tank 51.

Further, the dilution water pump 14 that supplies the dilution water to the mixers 13*a* and 13*b* and a water supply solenoid valve 26 that controls the water supply by the water pump are disposed on a tube 25*a* between the cold-water coil 52 disposed in the cold-water tank 51 and the pressure reducing valve 19, and tubes 27*a* and 27*b* are connected between a tube 25*b* on an outlet side of the cold water coil 52 and the mixers 13*a* and 13*b*. Further, a flow regulator 28*a* for controlling the flow rate and a dilution water solenoid valve 29*a* for controlling supply and stop of the dilution water are disposed on the tube 27*a*, and a flow regulator 28*b* for controlling the flow rate and a dilution water solenoid valve 29*b* are disposed on the tube 27*b*. It should be noted that the refrigerator unit 30 having therein a compressor, a condenser, an accumulator and so forth that are not shown in FIG. 3 is connected to the evaporator coil 53.

FIG. 5 is a block diagram showing a configuration of the controller of the dilution ratio adjusting apparatus of the beverage dispenser according to the present invention. The controller 100 as shown is generally configured to be provided with a memory 40 storing programs and data, and the CPU 41 that executes the programs stored in the memory 40. A dilution ratio adjusting program that executes a dilution ratio adjusting process to decide amounts of supply of the concentrated syrup and the dilution water per given time in accordance with the dilution ratio that is unique to the concentrated syrup, data related to thicknesses of the tubes 16*a* and 16*b*, and cup capacities S, M, L, and so forth are stored in the memory 40. It should be noted that concrete procedures in a specific process for adjusting the dilution ratio that the dilution ratio adjusting program stored in the memory 40 executes will be later described in "Changing process of the dilution ratio" to be described later. Further, the CPU 41 is connected respectively to the cooling unit 5, the remaining amount detecting sensors 15*a* and 15*b*, the operation panel 20, the switch panel 21, the refrigerator unit 30, and a tube pump driving unit 31 for driving the tube pumps 10*a* and 10*b* as described hereinbefore. Further, the tube pump driving section 31 is configured so as to include therein a control circuit to drive the non-illustrated stepping motors (which may also be referred to as "pulse motors") of the tube pumps 10*a* and 10*b*, a drive circuit, a power circuit and so forth. Note that in the case where the replenishment of the concentrated syrup is performed, it can be set to an initial state by resetting the setting values or the like. Further, a fine adjustment unit that performs a fine adjustment of the supplying amounts of the concentrated syrup may be provided in the controller 100 in order to correct a flow rate change based on a physical properties such as viscosity of the concentrated syrup and so on, where the fine adjustment unit may include a tab that is not shown for increasing or decreasing a driving pulse number or a pulse frequency of the stepping motors for driving the tube pumps 10*a* and 10*b* that is calculated in a later-described manner, or a numeric keypad that is not shown for inputting numerical values of the driving pulse number or the pulse frequency. For example, the correction of the change in the flow rates caused by the difference in the physical property such as viscosity and so forth orienting from density of soluble solid substances contained in the concentrated syrup can be performed by configuring the numerical values of the driving pulse number or the pulse frequency to be changeable by the tab or the numeric keypad.

[Operation of the Beverage Dispenser]

Figure 7:
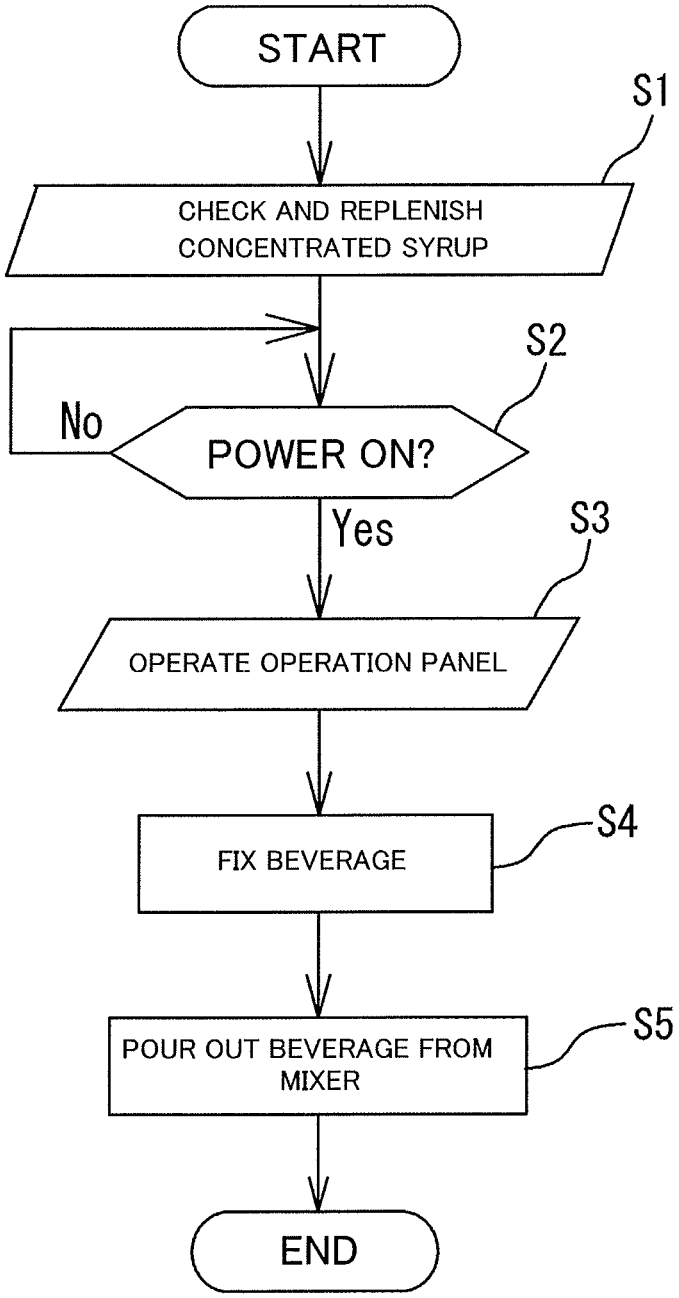
FIG. 7 is a flow chart showing an operation of the beverage dispenser according to the present invention.

Next, an operation of the aforementioned beverage dispenser 1 will be described. FIG. 7 is a flowchart showing the operation of the beverage dispenser. Firstly, the user or the like checks the current state of the beverage dispenser 1 before starting sales. Specifically, remaining amounts of the concentrated syrup in the syrup tanks 9*a* and 9*b* having maximum concentrated syrup contents of 4 litters are initially checked, and replenishment and replacement are performed as needed in an insufficient case (step S1). Normally, the beverage dispenser 1 is turned on at all times (step S2), and the cooling unit 5 is running so that cold-water is always stored in the cold-water tank 51. Here, when the user or the like places a container such as paper cups 23*a* and 23*b* at a predetermined position on the tray 3 shown in FIG. 1, and presses one of the small cup key 221, the medium cup key 222, and the large cup key 223 on the operation panel 20 depending on the container size (step S3), a beverage is fixed by a certain amount (for example, one of S=192 cc, M=265 cc, L=334 cc) of the concentrated syrup and the dilution water is supplied substantially at the same time to the mixer 13*a* (or 13*b*) by the tube pump 10*a* (or 10*b*) and the dilution water pump 14 and the dilution water solenoid valve 29*a* (or 29*b*) being operated (step S4). Then, a certain amount of beverage that has been diluted according to the predetermined dilution ratio is poured into the container 23*a* and/or 23*b* from the mixer 13*a* (or 13*b*) (step S5).

As the serving of the beverage is repeatedly conducted, when the contents of the concentrated syrup within the syrup tanks 9*a* and 9*b* decrease, the remaining amounts of the concentrated syrup are detected by the remaining amount detecting sensors 15*a* and 15*b*, and when the respective remaining amounts decrease to their set levels, the syrup remaining amount warning lamps 225*a* and 225*b* are brought into a state of turning-on in response thereto.

[Process of Changing the Dilution Ratio]

Figure 8:
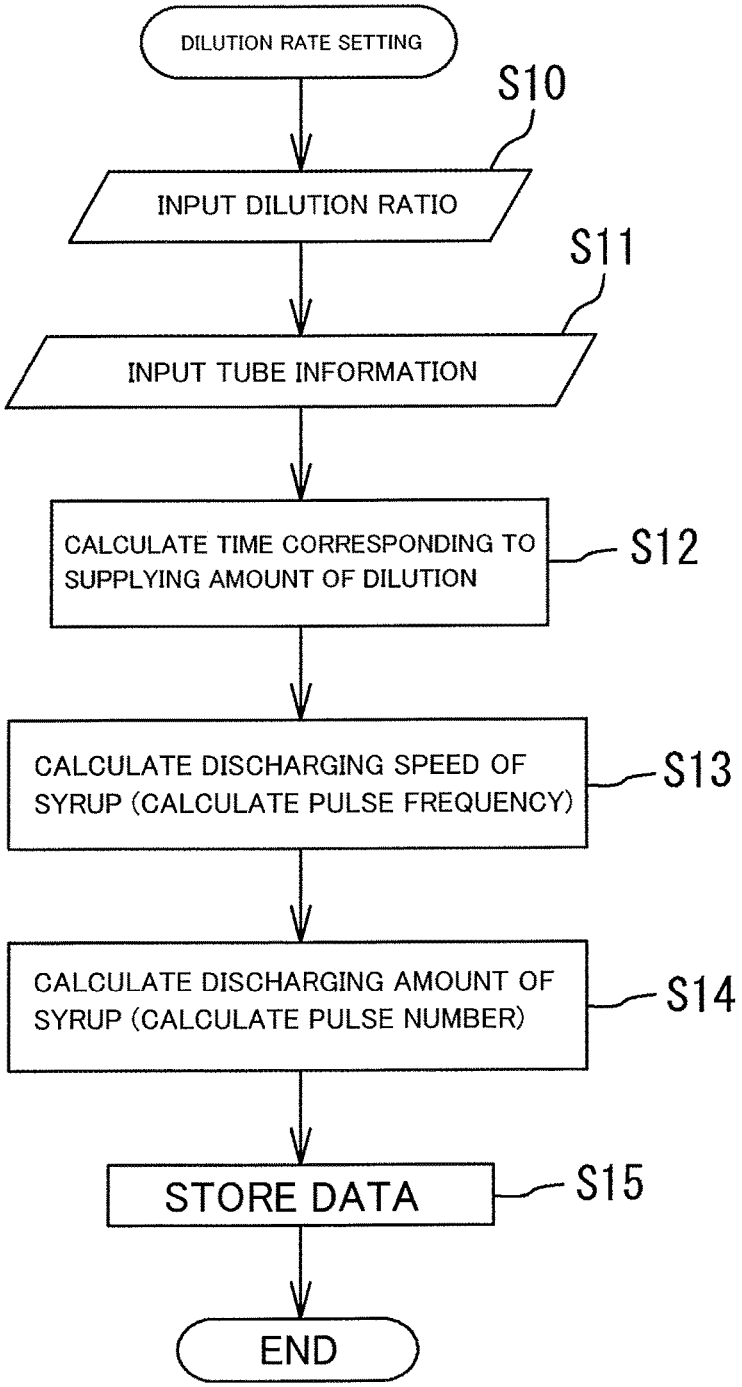
FIG. 8 is a flow chart showing a changing process of the dilution ratio for the concentrated syrup in the beverage dispenser according to the present invention.

Next, a description of the procedure in a case of changing of concentrated syrup with a different dilution ratio will be provided hereinbelow. FIG. 8 is a flowchart showing the changing process of a dilution ratio of the concentrated syrup in the beverage dispenser 1. Initially, the user or the like operates so as to input a numerical value of the dilution ratio of the concentrated syrup (dilution ratio data) by using the syrup extraction setting tabs 211*a* and 211*b* of the operation panel 21 or the numerical keypad that is not shown (step S10). For example, in a case where the dilution ratio is "1:5.4", the tab is set to "5.4", or the numerical value thereof is inputted. Note that although a dilution rate in this case will be 6.4 times, the controller 100 may alternatively be configured by using this numerical value of the dilution rate. Further, information with respect to types of tubes (of which details are to be described later) for transporting the concentrated syrup to the mixers 13*a* and 13*b* is inputted via input section that are not shown of the operation panel 21 (step S11). Then, when the controller 100 receives the dilution ratio data and the information regarding the types of the tubes as inputted, this information are stored in the memory 40. Further, calculation formulas for calculating a driving pulse number and a pulse frequency to be given to the stepping motors that are not shown for driving the tube pumps 10*a* and 10*b*, which would be needed for supplying the amount of the concentrated syrup necessary for serving the beverage of the specified cup size, based on the dilution ratio data and the information regarding the types of the tubes as inputted, and in addition information as to the cup size being which one of the large, medium, and small cup sizes are stored in the memory 40, and the calculation of the driving pulse number and the pulse frequency that would be necessary for causing the tube pumps 10*a* and 10*b* to be driven by using the calculation formula.

Here, the non-illustrated stepping motors that are the driving power sources of the tube pumps 10*a* and 10*b* change their rotation (rotation angle (°)) by the pulse number (driving pulse number) (P), and change their rotational speed (N) by the pulse frequency (Hz). That is to say, relationships thereamong are expressed as set froth below.

$$\text{Rotation Angle } (°) = \text{Step Angle } (°) \times \text{Pulse Number } (P) \quad \text{[Equation 1]}$$

$$\text{Rotational Speed } (N) \text{ (rpm)} = \text{Pulse Frequency (pulse/sec)} \times 60 \text{ (sec)} \times \text{Step Angle } (°) \div 360° \quad \text{[Equation 2]}$$

Further, the rotation angle (°) is an angle of rotation of the rotors 113 of the tube pumps 10*a* and 10*b* (that is, rotation angle of motor output shafts), and is related to an extracted content (cc) of the concentrated syrup. Further, the step angle (°) is determined by a phase number of each motor, and the stepping angle in the case of the stepping motors of the described embodiment is "1.8°/pulse".

The driving pulse number and the pulse frequency necessary for the concentrated syrup by each stepping motor are calculated in a manner as described below, based on the above calculation formulas.

That is, if it is assumed that the start and completion of discharges of the dilution water and the concentrated syrup occur at the same time, the necessary pulse frequency (pulse/sec) of the stepping motor is:

$$\text{Pulse Frequency (pulse/sec)} = [\text{Dilution Water Flow Rate} \div \text{Dilution Ratio Value}] \div \text{Concentrated Syrup Basic Flow Rate} \quad \text{[Equation 3]}$$

Here, the "basic flow rate" is an exporting amount per one pulse under a thickness of the predetermined tube of the tube pump, and an example thereof is as follows.

S tube: 0.011 cc/1 pulse

M tube: 0.027 cc/1 pulse

The S tube and the M tube are provided because there are cases in which a size of the tube to be used may differ in a case of using the tube that is preliminarily attached to the BIB (proper use depending on the dilution rate), and in a case of using the tubes (tubes 16*a* and 16*b*) extending from the syrup tanks 9*a* and 9*b* to the tube pumps 10*a* and 10*b*, and so forth. For example, the S tube is primarily used in the case of the concentrated syrup having a high dilution rate. Further, the dilution water flow rate is taken into consideration so as to supply the necessary amount of the concentrated syrup during the same time period as the supplying time of the dilution water so that irregularity of mixture might not occur as possible.

[Case of Serving S-Sized Beverage with M Tube]

Dilution Ratio 1:5.4

If the dilution ratio is set to be 5.4, the dilution water is mixed by the rate of 5.4 with respect to the concentrated syrup with the rate of 1, so the concentrated syrup transporting flow rate (f) that will be necessary in a case where the dilution water flow rate is provided at 32 cc/sec will become as shown below.

1:5.4 (Dilution Ratio Value)=Concentrated Syrup Exporting Flow Rate (*f*):32 (cc/sec)

Concentrated Syrup Discharging Flow Rate (*f*)=32 (cc/sec)÷5.4=5.93 (cc/sec) [Equation 4]

Further, the required pulse per one second in order to supply the concentrated syrup of 5.93 (cc/sec) using the M tube with the concentrated syrup basic flow rate of 0.027 (cc/pulse) during the same time period as the supplying time of the dilution water, that is, the pulse frequency, is as follows.

Pulse Frequency (pulse/sec)=5.93 (cc/sec)÷0.027 (cc/pulse)=219.6 pulse/sec (about 220 pulse/sec) [Equation 5]

Further, in the case of the cup size of S, since the content thereof is 192 cc, the required amount of the dilution water is as follows.

192 cc×5.4÷6.4=162 cc [Equation 6]

Further, the time to discharge 162 cc of the dilution water is as follows.

162 cc÷32 cc/sec=5.06 seconds [Equation 7]

Further, the required amount of the concentrated syrup with respect to 162 cc is as follows.

192 cc×(1÷6.4)=30 cc [Equation 8]

Further, the required driving pulse number for exporting the amount of the concentrated syrup is as follows.

30 cc÷0.027 (cc/pulse)=1,111 (pulses) [Equation 9]

Further, the rotational speed of the rotor at this occasion is as follows.

220 pulse/sec×60 seconds×1.8°÷360°=66 rpm [Equation 10]

Further, the number of revolution of the rotor is as follows.

(1.8°×1111 pulses)÷360°=5.6 Turns [Equation 11]

Note that since the tube pumps 10*a* and 10*b* supplies the concentrated syrup in a pulsatory motion, although the discharging flow rate is not constant if viewed from a microscopic perspective in dividing the time in very short terms, there is no problem in considering that a constant amount is evenly supplied from a macroscopic perspective by ignoring the pulsatory motion, because the concentrated syrup for one serving is supplied by the rotor 113 rotating for 5 times or more.

[Case of Serving L-Sized Beverage with S Tube]

Dilution Ratio 1:10.0

If the dilution ratio is 10.0, the dilution water is mixed by the rate of 10.0 with respect to the concentrated syrup with the rate of 1.0, so the concentrated syrup discharging flow rate (f) that will be needed in a case where the dilution water flow rate is provided at 32 (cc/sec) will be as follows.

1:10.0 (Dilution Ratio Value)=Concentrated Syrup Transporting Flow Rate (*f*):32 (cc/sec)

Concentrated Syrup Transporting Flow Rate (*f*)=32 (cc/sec)÷10.0=3.20 (cc/sec) [Equation 12]

Further, the required pulse per one second in order to supply the concentrated syrup of 3.20 (cc/sec) using the S tube with the concentrated syrup basic flow rate of 0.011 (cc/pulse) during the same time period as the supplying time of the dilution water, that is, the pulse frequency, is as follows.

Pulse Frequency (pulse/sec)=3.20 (cc/sec)÷0.011 (cc/pulse)=291.0 pulses/sec [Equation 13]

Further, in the case of the cup size of L, since the content thereof is 334 cc, the required amount of the dilution water is as follows.

334 cc×10.0÷11.0=303.6 cc [Equation 14]

Further, the time to convey 303.6 cc of the dilution water is as follows.

303.6 cc÷32 cc/sec=9.49 seconds [Equation 15]

Further, the required amount of the concentrated syrup with respect to 334 cc is as follows.

334 cc×(1÷11.0)=30.4 cc [Equation 16]

Further, the required driving pulse number for transporting this amount of concentrated syrup is as follows.

30.4 cc÷0.011 (cc/pulse)=2764 (pulses) [Equation 17]

Further, the rotational speed of the rotor at this occasion is as follows.

291 pulse/sec×60 sec×1.8°÷360°=87.3 rpm [Equation 18]

Further, the number of revolution of the rotor is as follows.

(1.8°×2764 pulses)÷360°=13.8 turns [Equation 19]

Next, a description of supplying operation of the concentrated syrup on the basis of the dilution ratio obtained by the above-described calculation method will be provided below. It should be noted that such an assumption is made that the concentrated syrup having the dilution ratio of 5.4 is herein used. Initially, the dilution ratio of the concentrated syrup is inputted (step S10), and the information on the tube to be used is also inputted (step S11). The transporting amount per one pulse is set by the input of the tube information. At this stage, it is assumed that the M tube has been set. Then, when the small cup key 221 of the operation panel 20 is pressed by the user or the like, the calculation of the time necessary for supplying the necessary amount of dilution water by opening the dilution water solenoid valve 29*a* (or 29*b*) is performed, based on the equation 7 (step S12). That is to say, the time for keeping the dilution water solenoid valve 29*a* (or 29*b*) be opened for supplying of the dilution water of 162 cc that is to be necessary for the case of the cup capacity of the S size is calculated to be approximately 5 seconds. Further, the transporting speed of the concentrated syrup, that is, the pulse frequency is calculated based on the equation 3 (step S13). Meanwhile, by the small cup key 221 having been pressed, the necessary driving pulse number to be given to the stepping motor of the tube pump 10*a* (or 10*b*) in order to supply the concentrated syrup by the same time as the supplying time of the dilution water is calculated based on the equation 9 (step S14), the amount of the concentrated syrup to be supplied is calculated based on the equation 8, and the rotational speed of the rotor 113 is calculated based on the equation 11. That is to say, since the dilution ratio is "5.4" and the tube is "M tube", in the case of the S cup, the controller 100 determines that, based on the equations 9 to 11, the necessary driving pulse number to be given to the motor of the tube pump 10*a* (or 10*b*) is 1,111 pulses, and further the pulse frequency is 220 pulse/sec, the CPU 41 sends the calculation results to the tube pump driving section 31, and the tube pump driving section 31 causes the tube pump 10*a* (or 10*b*) to operated based on the calculation results. Note that the respective calculation results in steps S12 through S14 are stored in the memory 40 shown in FIG. 5 (step S15), respectively.

Figure 6:
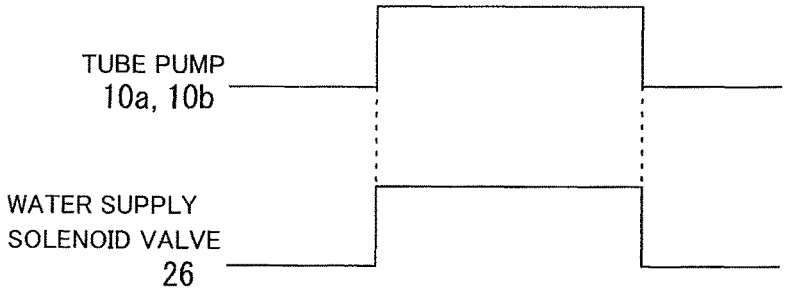
FIG. 6 is a time chart of the operations of the tube pump and a water supply solenoid valve.

The supplying time of the dilution water by the dilution water solenoid valve 29*a* (or 29*b*) and the water supply solenoid valve 26 and the operating time of the tube pump 10*a* (or 10*b*) based on the driving pulse number and the pulse frequency to be given to the tube pump 10*a* (or 10*b*) from the controller 100 are started at substantially the same time and ends at the same time as shown in FIG. 6, and the fixing of the beverage is thereby ended. Therefore, the adjustment of the beverage dispenser 1 accompanying the replacement of the syrup can be completed quickly and automatically by specifying the dilution ratio. Further, the transporting amount of the concentrated syrup can be corrected as needed by configuring the numerical value of the driving pulse number or the pulse frequency to be changeable by a non-illustrated tab or a non-illustrated numerical keypad for increasing or decreasing the driving pulse number or the pulse frequency of the stepping motors for driving the tube pumps 10*a* and 10*b* as calculated in the controller 100.

Advantageous Effects of Embodiment

It should be appreciated that, owing to an apparatus for and a method of adjusting a dilution ratio in a beverage dispenser, according to the described embodiment of the present invention, since an amount of supply of the concentrated syrup can be automatically adjusted depending on a change in a dilution ratio of the concentrated syrup and also depending on difference in the size of cups to be served with the beverage, such an advantage can be achieved that the concentrated syrup may be selectively varied to ones having different dilution rates without need of performing any troublesome operation. Therefore, the time from the replacement of the concentrated syrup to the start of service can be significantly reduced.

From the foregoing, it will be understood that although the detailed description of the present invention is provided by way of the preferred embodiment thereof, the present invention is not limited to this specific embodiment, and it should be understood that various modifications and alteration may be made without departing from the scope and sprit of the present invention claimed in the appended claims.

REFERENCE SIGNS LIST

1 BEVERAGE DISPENSER
2 DOOR
3 TRAY
4 HOUSING
5 COOLING SECTION
6 CONDENSER
7 COMPRESSOR
8 COOLING BOX
9*a*, 9*b* SYRUP TANK
10*a*, 10*b* TUBE PUMP
11 HEAT EXCHANGER
12 FAN MOTOR
13*a*, 13*b* MIXER
14 DILUTION WATER PUMP
15*a*, 15*b* REMAINING AMOUNT DETECTING SENSOR
16*a*, 16*b*, 17*a*, 17*b* TUBE
18 TUBE
19 PRESSURE REDUCING VALVE
20 OPERATION PANEL
21 ADJUSTING SWITCH PANEL
22*a*, 22*b* CUP SELECTION KEY
23*a*, 23*b* CONTAINER
24 WATER SUPPLY SOLENOID VALVE
25*a*, 25*b*, 27*a*, 27*b* TUBE
26 WATER SUPPLY SOLENOID VALVE
28*a*, 28*b* FLOW REGULATOR
29*a*, 29*b* DILUTION WATER SOLENOID VALVE
30 REFRIGERATOR UNIT
31 TUBE PUMP DRIVING SECTION
40 MEMORY
41 CPU
51 COLD-WATER TANK
52 COLD-WATER COIL
53 EVAPORATOR COIL MULTI PUMP
100 CONTROLLER
112 DRIVE SHAFT
113 ROTOR
115*a*, 115*b*, 115*c* SQUEEZE ROLLER
116 FIXED GUIDE
117 PIN
211*a*, 211*b* SYRUP EXTRACTION SETTING TAB
212 LEFT REMAINING AMOUNT STOP RELEASE SWITCH
213 RIGHT REMAINING AMOUNT STOP RELEASE SWITCH
215 SYRUP EXTRACTING SWITCH
216 POTION TIME SETTING SWITCH
217 SYSTEM RESET BUTTON
218 SALES SWITCH
221 SMALL CUP KEY
222 MEDIUM CUP KEY
223 LARGE CUP KEY
224*a*, 224*b* CANCEL/POUR (C/P) KEY
225*a*, 225*b* SYRUP REMAINING AMOUNT WARNING LAMP
226 SALES LAMP
227 TANK WATER SUPPLY WARNING LAMP

What is claimed is:

1. A beverage dispenser for fixing a cup of beverage with concentrated syrup and dilution water premixed together at a mixing station at a predetermined dilution ratio so as to be capable of being supplied from the mixing station into a cup of desired cup size from among a plurality of different selectable cup sizes, comprising:

a syrup supply source for supplying at least one type of concentrated syrup for a beverage via a tube element having a given tube thickness for fonning therein a fluid conduit and extending to the mixing station by way of a tube pump arranged to be driven by a pulse-operated drive motor;

a dilution water supply unit for supplying a flow of dilution water at a preselected constant flow rate (volume/unit time) to the mixing station, wherein the flow of dilution water is passed through a flow regulator for controlling fluid flow rate and an electronically-operated solenoid valve for the dilution water adapted to be electronically-operated and closably opened for allowing the flow of the dilution water to pass therethrough at the preselected constant flow rate during opening thereof;

at least one mixer arranged at the mixing station to blend therein the concentrated syrup and the dilution water thereby fixing the beverage to be supplied into a cup of the desired cup-size selected from among a plurality of different cup-sizes; and, a dilution ratio adjusting device configured to blend the concentrated syrup with the dilution water at the predetermined dilution ratio to thereby fix the beverage to be supplied into the cup of a selected one of the different cup sizes, wherein the dilution ratio adjusting device comprises a controller unit including:

a memory unit for storing therein a dilution ratio adjusting program, and (a) data of at least one dilution ratio predetermined to be suited for at least one type of concentrated syrup for fixing a beverage, (b) data of a plurality of different (small to large) cup-sizes for the fixed beverage, (c) data of tube information including a plurality of given tube thickness values of a respective plurality of different tube elements, each being used for conveying concentrated syrup from the syrup supply source by way of the tube pump, (d) data of a flow rate of dilution water supplied by the dilution water supply unit as per a unit time, and (e) data of each amount of concentrated syrup delivered by the tube pump in association with the data of a selected tube thickness value of a respective one of the plurality of tube elements, a data processing unit for implementing the dilution ration adjusting program according to the stored data of the memory unit thereby calculating amounts of the concentrated syrup and the dilution water to allow an amount of beverage to be blended and fixed within a substantially same identical time duration from start to stop for a selected one of the plurality of different cup sizes, wherein the data processing unit is configured to store or hold, in the memory unit, data of the calculated amounts of the concentrated syrup and the dilution water for at least one type of concentrated syrup and for each of the plurality of different cup sizes;

a cup-size selecting unit for inputting a selection of a desired cup size to be supplied with concentrated syrup and dilution water for the beverage from the memory unit into the data processing unit;

a syrup type selecting unit for inputting a selection of a type of concentrated syrup for the beverage from the memory unit into the data processing unit;

a dilution water control unit for controlling operation of the electronically-operated solenoid valve for the dilution water and the flow regulator, respectively, to thereby allow the calculated amount of dilution water to flow into a predetermined cup via the mixer based upon the selection input from the cup-size selection unit and the selection input from the syrup type selecting unit: and, a drive unit for driving the pulse-operated drive motor to thereby operate the tube-pump so that the calculated amount of concentrated syrup is supplied into the cup via the mixer, based on both the selection input from the syrup type selecting unit and the selection input from the cup-size selecting unit.

2. The beverage dispenser as set forth in claim 1, wherein the controller unit of the dilution ratio adjusting device further includes a fine adjustment unit that performs a fine adjustment of an amount of concentrated syrup to be supplied into the cup of selected cup-size by increasing or decreasing a number of drive pulse or a frequency of pulse to thereby adjustably control the operation of the tube pump.

3. The beverage dispenser as set forth in claim 1, wherein the controller unit of the dilution ratio adjusting device is further provided with a detecting unit for detecting an amount of concentrated syrup remaining in the syrup supply source through calculation of an amount of concentrated syrup supplied by the tube pump in relation to a total amount of concentrated syrup provided in the syrup supply source, and an alarm indication unit for indicating when the remaining amount of concentrated syrup reaches a predetermined alarm level.

4. The beverage dispenser as set forth in claim 1, wherein the dilution ratio adjusting program implemented by the data processing unit comprises a calculation program for obtaining, by calculation, a drive pulse frequency for driving the pulse-operated drive motor driving the rotor element of the tube pump with respect to one selected type of syrup and a cup of one selected cup size, based on the data of the dilution ratio unique to the one selected type of syrup, the data of the flow rate of dilution water, the date of tube information including a tube thickness value of a tube element to be used for allowing the said one selected type of syrup to flow therethrough and the data of the amount of concentrated syrup delivered by the tube pump, said data being derived from the memory unit.

* * * * *